US011161653B2

(12) United States Patent
Robinson

(10) Patent No.: US 11,161,653 B2
(45) Date of Patent: Nov. 2, 2021

(54) BUCKET LID ASSEMBLY

(71) Applicant: Russell Robinson, Tacoma, WA (US)

(72) Inventor: Russell Robinson, Tacoma, WA (US)

( * ) Notice: Subject to any disclaimer, the term of this patent is extended or adjusted under 35 U.S.C. 154(b) by 141 days.

(21) Appl. No.: 16/592,141

(22) Filed: Oct. 3, 2019

(65) Prior Publication Data

US 2021/0101721 A1 Apr. 8, 2021

(51) Int. Cl.

| | |
|---|---|
| ***B65D 43/02*** | (2006.01) |
| ***B65D 25/02*** | (2006.01) |
| *B01F 7/16* | (2006.01) |

(52) U.S. Cl.

CPC ..... *B65D 43/0208* (2013.01); *B65D 25/02* (2013.01); *B01F 7/16* (2013.01); *B65D 2543/00092* (2013.01); *B65D 2543/00296* (2013.01); *B65D 2543/00555* (2013.01); *B65D 2543/00685* (2013.01)

(58) Field of Classification Search

CPC ..... B65D 43/0208; B65D 25/02; B65D 2543/00092; B65D 2543/00296; B65D 2543/00555; B65D 2543/00685; B01F 7/16

See application file for complete search history.

(56) References Cited

U.S. PATENT DOCUMENTS

| | | | | |
|---|---|---|---|---|
| 1,503,190 | A | 7/1924 | Kim | |
| 5,111,854 | A * | 5/1992 | Begley | B65B 69/00 141/312 |
| 5,236,102 | A | 8/1993 | Quittmann | |
| 7,270,233 | B2 | 9/2007 | Kindt | |
| 7,565,985 | B2 | 7/2009 | Lucey | |
| D649,871 | S | 12/2011 | Noer | |
| D699,871 | S * | 2/2014 | Zolotykh | D26/2 |
| 8,887,539 | B1 * | 11/2014 | Hernandez | D06F 5/04 68/57 |
| 2003/0062366 | A1 * | 4/2003 | Moss | B65D 43/0212 220/229 |
| 2012/0175012 | A1 * | 7/2012 | Goodwin | B01F 7/00691 141/11 |
| 2015/0021335 | A1 | 1/2015 | Kovitz | |
| 2015/0048093 | A1 | 2/2015 | Aki | |
| 2018/0242722 | A1 | 8/2018 | Patterson | |

FOREIGN PATENT DOCUMENTS

| | | |
|---|---|---|
| WO | WO2006053123 | 5/2006 |

* cited by examiner

*Primary Examiner* — Shawn M Braden

(57) ABSTRACT

A bucket lid assembly for mixing contents of a closed bucket includes a lid that has flat portion and a channel portion is integrated into the flat portion. The channel portion releasably engages a bucket for closing the bucket. The flat portion is comprised of a translucent material to facilitate contents of the bucket to be visible through the lid. The lid has a mixer opening extending therethrough such that a mixing wand is insertable through the mixer opening. In this way the lid facilitates the contents of the bucket to be mixed while the bucket is closed with the lid.

3 Claims, 5 Drawing Sheets

BUCKET LID ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to lid device and more particularly pertains to a new lid device for mixing contents of a closed bucket.

(2) Description of Related Art Including Information Disclosed Under 37 CFR 1.97 and 1.98

The prior art relates to lid device.

BRIEF SUMMARY OF THE INVENTION

An embodiment of the disclosure meets the needs presented above by generally comprising a lid that has flat portion and a channel portion is integrated into the flat portion. The channel portion releasably engages a bucket for closing the bucket. The flat portion is comprised of a translucent material to facilitate contents of the bucket to be visible through the lid. The lid has a mixer opening extending therethrough such that a mixing wand is insertable through the mixer opening. In this way the lid facilitates the contents of the bucket to be mixed while the bucket is closed with the lid.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
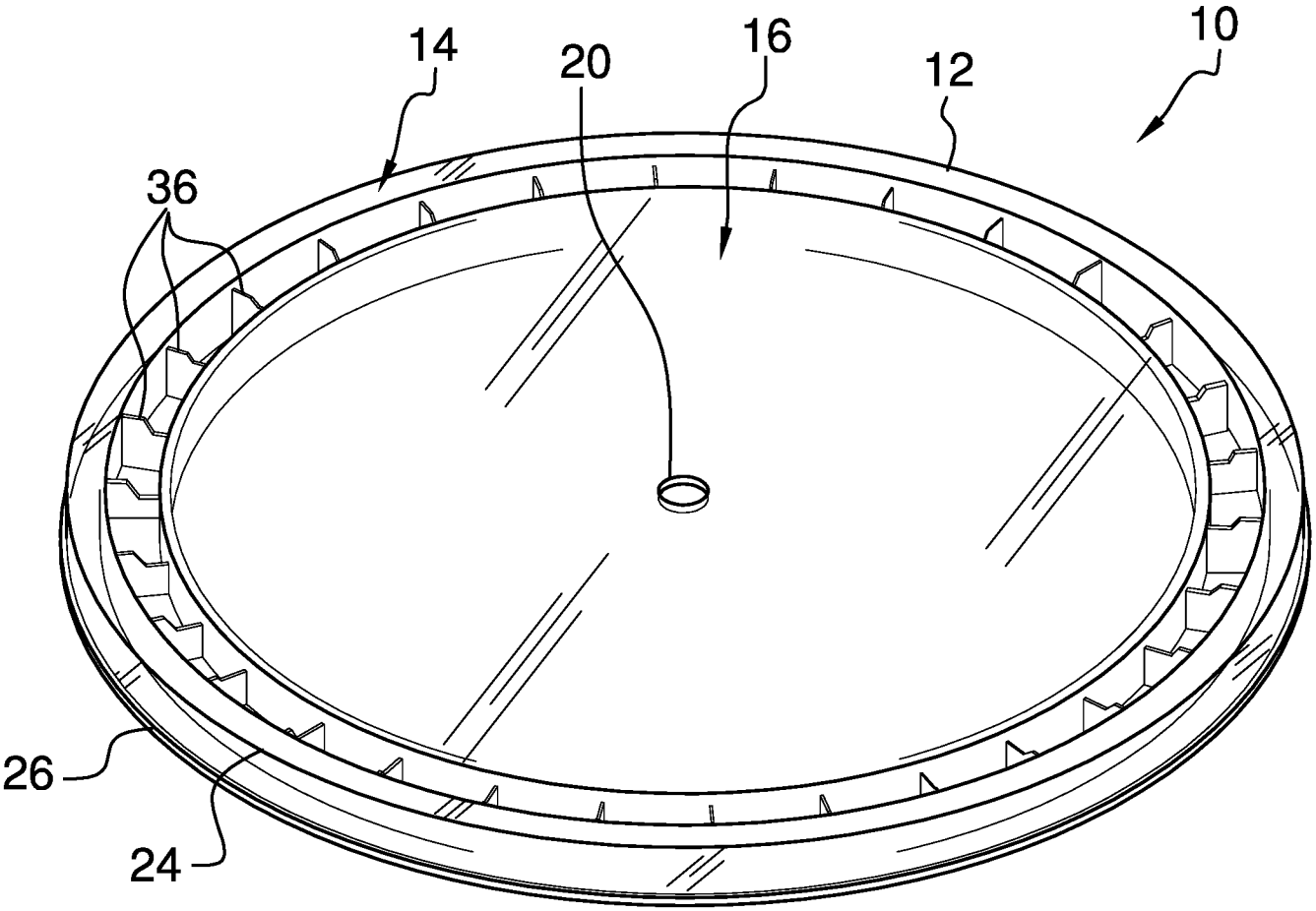
FIG. 1 is a top perspective view of a bucket lid assembly according to an embodiment of the disclosure.
Figure 2:
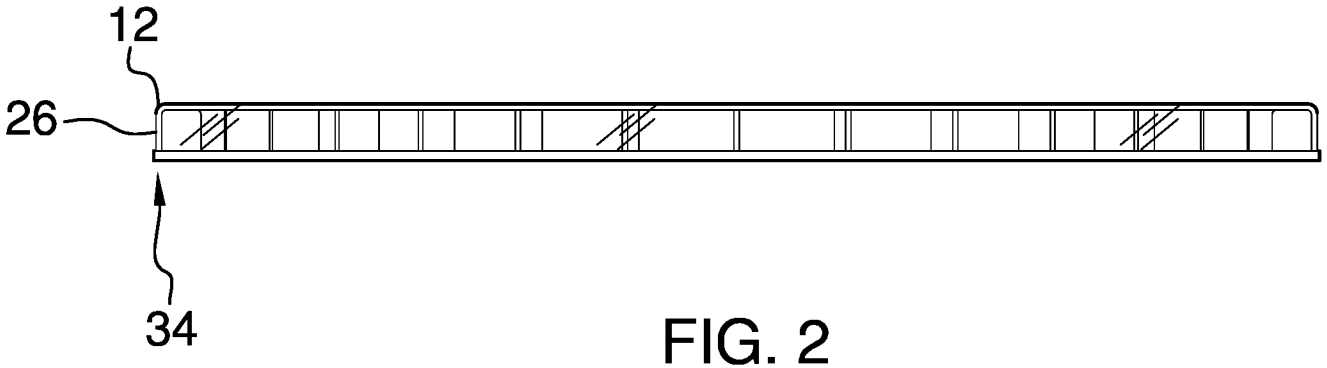
FIG. 2 is a side view of an embodiment of the disclosure.
Figure 3:
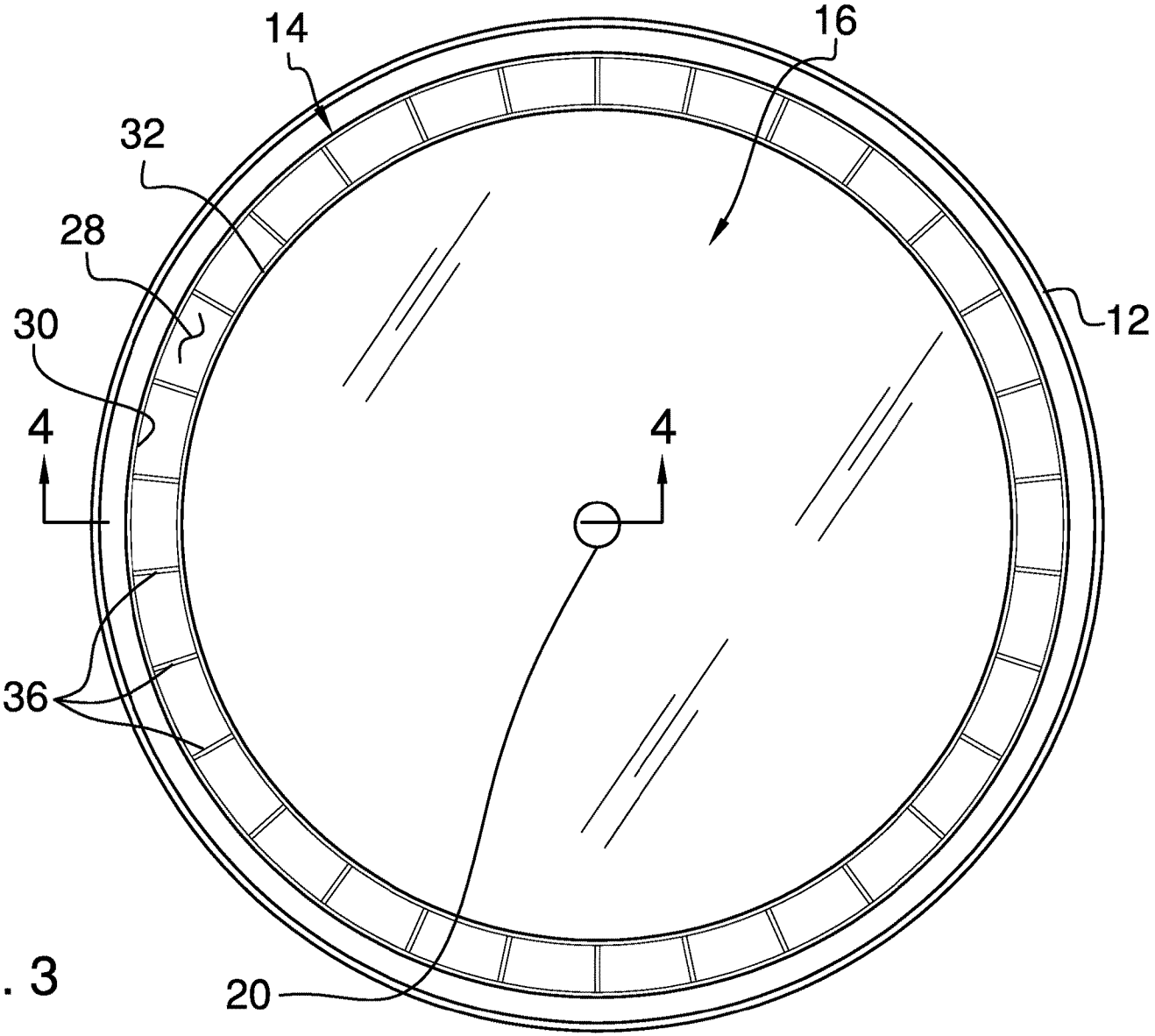
FIG. 3 is a top view of an embodiment of the disclosure.
Figure 4:
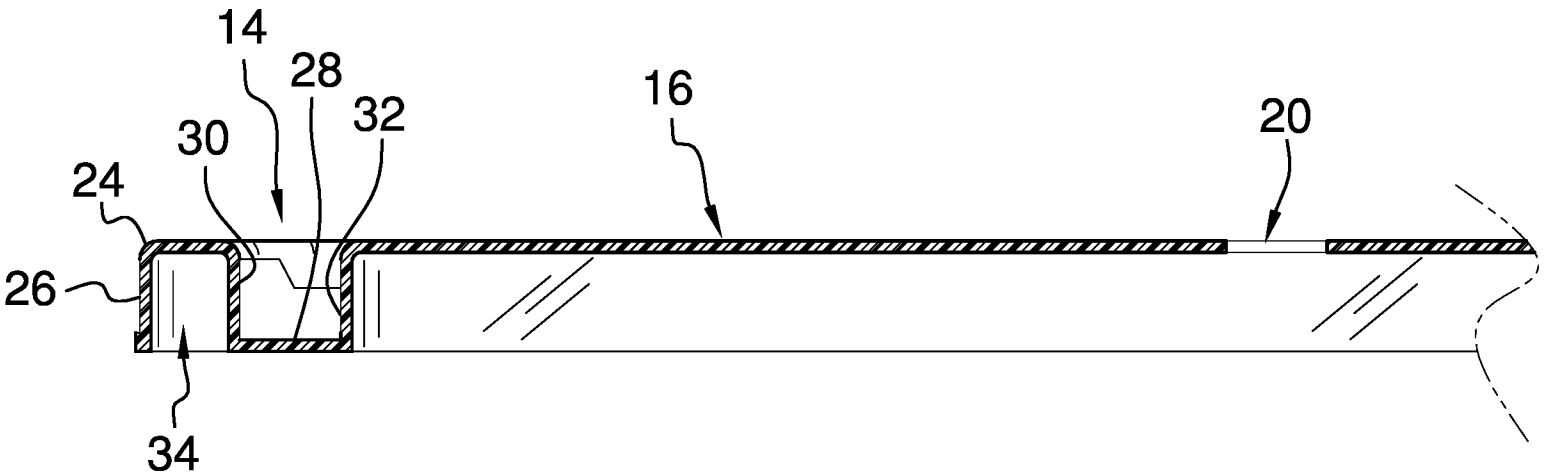
FIG. 4 is a cross sectional view taken along line 4-4 of FIG. 4 of an embodiment of the disclosure.
Figure 5:
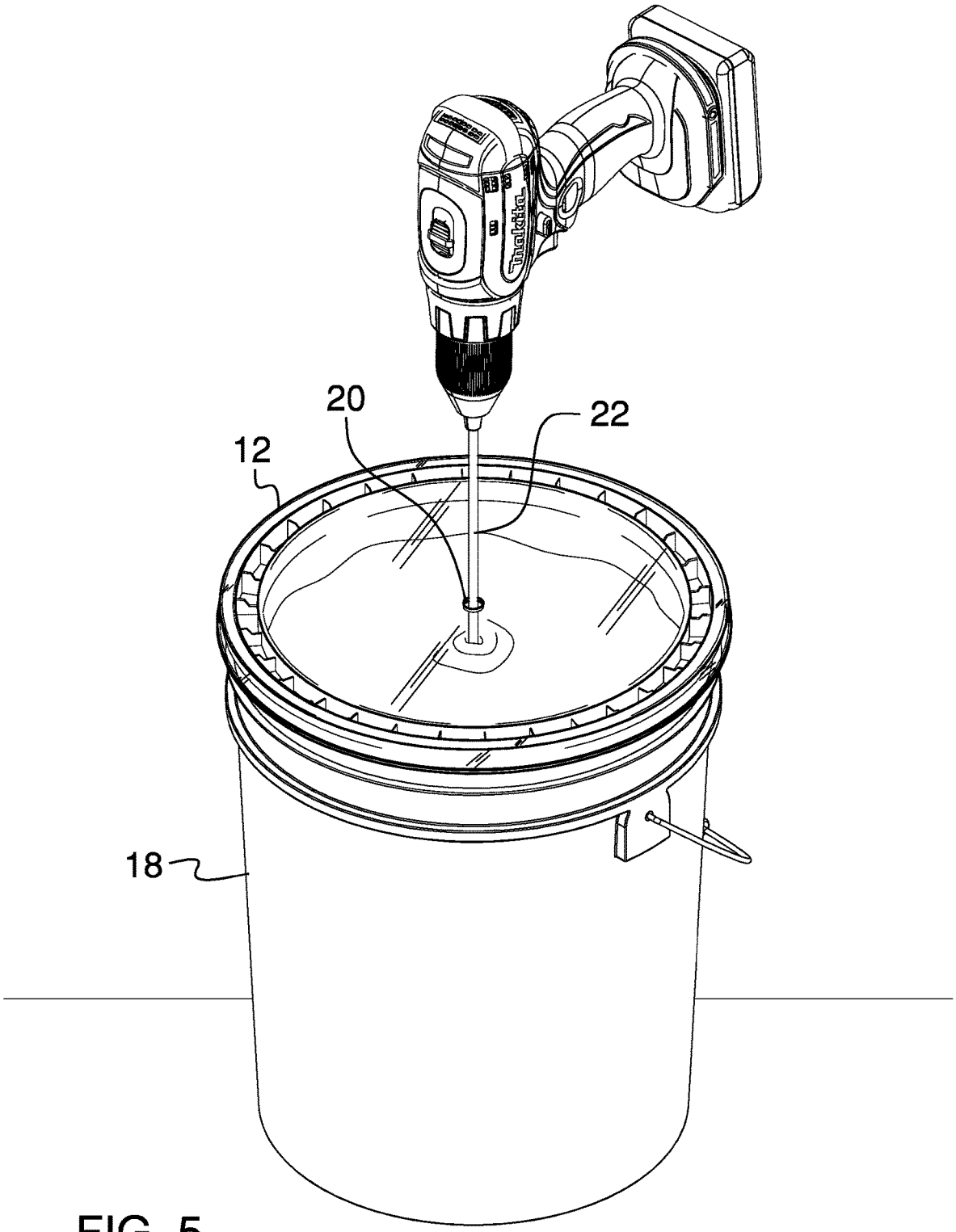
FIG. 5 is a perspective in-use view of an embodiment of the disclosure.

With reference now to the drawings, and in particular to FIGS. 1 through 5 thereof, a new lid device embodying the principles and concepts of an embodiment of the disclosure and generally designated by the reference numeral 10 will be described.

As best illustrated in FIGS. 1 through 5, the bucket lid assembly 10 generally comprises a lid 12 has a channel portion 14 and a flat portion 16 is surrounded by the channel portion 14. The channel portion 14 releasably engages a bucket 18 for closing the bucket 18. The bucket 18 may be a 5.0 gallon paint bucket or other bucket of similar dimensions. The flat portion 16 is comprised of a translucent material to facilitate contents of the bucket 18 to be visible through the lid 12. The lid 12 has a mixer opening 20 extending therethrough such that a mixing wand 22 is insertable through the mixer opening 20. In this way the lid 12 facilitates the contents of the bucket 18, such as paint or other fluid, to be mixed while the bucket 18 is closed with the lid 12. The mixing wand 22 may be a rotating mixer with a shaft that is couple to an electric drill or the like.

The mixer opening 20 is centrally positioned in the flat portion 16 and the flat portion 16 has a perimeter edge 24 that is continuously arcuate about the mixer opening 20. The flat portion 16 has a lip 26 extending downwardly from the perimeter edge 24 and the lip 26 is coextensive with the perimeter edge 24. The channel portion 14 has a lower bounding surface 28 extending between a first lateral bounding surface 30 and a second lateral bounding surface 32. The first lateral bounding surface 30 is spaced inwardly on the flat portion 16 from the lip 26 to define a bucket space 34 between the lip 26 and the first lateral bounding surface 30. The first lateral bounding surface 30 is coextensive with the lip 26 and the bucket space 34 insertably receives the top edge of the bucket 18.

A plurality of spacers 36 is provided and each of the spacers 36 is coupled to the lid 12. Each of the spacers 36 is positioned in the channel portion 14. Additionally, each of the spacers 36 extends between the first lateral bounding surface 30 and the second lateral bounding surface 32 of the channel portion 14. The spacers 36 are spaced apart from each other and are distributed around an entire circumference of the channel portion 14.

In use, the existing lid 12 on a 5.0 gallon bucket of paint is removed to facilitate any pigments to be added to the paint in the 5.0 gallon bucket. The mixing wand 22 is inserted through the mixing opening and the lid 12 in the embodiment is installed on the 5.0 gallon bucket. In this way the paint and the pigment are visible through the flat portion 16 of the lid 12 during mixing. Additionally, the paint is inhibited from spilling outwardly from the 5.0 gallon bucket during mixing.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bucket lid assembly being configured to have a mixing wand extended therethrough for mixing contents of a bucket without spillage, said assembly comprising:

a lid having flat portion and a channel portion being integrated into said flat portion, said channel portion releasably engaging a bucket for closing the bucket, said flat portion being comprised of a translucent material to facilitate contents of the bucket to be visible through said lid, said lid having a mixer opening extending therethrough such that a mixing wand is insertable through said mixer opening wherein said lid is configured to facilitate the contents of the bucket to be mixed while the bucket is closed with said lid;

wherein said mixer opening is centrally positioned in said flat portion, said flat portion having a perimeter edge being continuously arcuate about said mixer opening, said flat portion has a lip extending downwardly from said perimeter edge, said lip being coextensive with said perimeter edge;

wherein said channel portion has a lower bounding surface extending between a first lateral bounding surface and a second lateral bounding surface, said first lateral bounding surface being spaced inwardly on said flat portion from said lip; and a plurality of spacers, each of said spacers being coupled to said lid, each of said spacers being positioned in said channel portion, each of said spacers extending between said first lateral bounding surface and said second lateral bounding surface of said channel portion, said spacers being spaced apart from each other and being distributed around an entire circumference of said channel portion.

2. The assembly according to claim 1, wherein a bucket space is defined between said lip and said first lateral bounding surface, said first lateral bounding surface being coextensive with said lip.

3. A bucket lid assembly being configured to have a mixing wand extended therethrough for mixing contents of a bucket without spillage, said assembly comprising:

a lid having a channel portion and a flat portion being surrounded by said channel portion, said channel portion releasably engaging a bucket for closing the bucket, said flat portion being comprised of a translucent material to facilitate contents of the bucket to be visible through said lid, said lid having a mixer opening extending therethrough such that a mixing wand is insertable through said mixer opening wherein said lid is configured to facilitate the contents of the bucket to be mixed while the bucket is closed with said lid, said mixer opening being centrally positioned in said flat portion, said flat portion having a perimeter edge being continuously arcuate about said mixer opening, said flat portion having a lip extending downwardly from said perimeter edge, said lip being coextensive with said perimeter edge, said channel portion having a lower bounding surface extending between a first lateral bounding surface and a second lateral bounding surface, said first lateral bounding surface being spaced inwardly on said flat portion from said lip to define a bucket space between said lip and said first lateral bounding surface, said first lateral bounding surface being coextensive with said lip, said bucket space insertably receiving a top edge of the bucket; and a plurality of spacers, each of said spacers being coupled to said lid, each of said spacers being positioned in said channel portion, each of said spacers extending between said first lateral bounding surface and said second lateral bounding surface of said channel portion, said spacers being spaced apart from each other and being distributed around an entire circumference of said channel portion.

* * * * *